US005488916A

United States Patent [19]

Bozzuto

[11] Patent Number: 5,488,916

[45] Date of Patent: Feb. 6, 1996

[54] LOW EMISSION AND LOW EXCESS AIR STEAM GENERATING SYSTEM AND METHOD

[75] Inventor: Carl R. Bozzuto, Enfield, Conn.

[73] Assignee: Combustion Engineering, Inc., Windsor, Conn.

[21] Appl. No.: 322,216

[22] Filed: Oct. 13, 1994

Related U.S. Application Data

[63] Continuation-in-part of Ser. No. 174,777, Dec. 12, 1993, abandoned.

[51] Int. Cl.[6] ..... F23D 1/00

[52] U.S. Cl. ..... 110/347; 110/345; 110/186

[58] Field of Search ..... 110/347, 345, 110/186, 187, 188, 232

[56] References Cited

U.S. PATENT DOCUMENTS

| | | | |
|---|---|---|---|
| 4,332,207 | 6/1982 | Biaskowski et al. | 110/347 |
| 4,518,123 | 5/1985 | Tanaka et al. | 241/18 |
| 4,622,922 | 11/1986 | Miyagaki | 122/448 |
| 4,969,408 | 11/1990 | Archer et al. | 110/347 |
| 5,155,047 | 10/1992 | Cioni et al. | 110/347 |
| 5,158,024 | 10/1992 | Tanaka et al. | 110/186 |

*Primary Examiner*—Thomas E. Denion
*Attorney, Agent, or Firm*—Chilton, Alix & Van Kirk

[57] ABSTRACT

A pulverized coal steam generator employing tangential, concentric firing with oxidizing conditions adjacent the furnace walls and using overfire air and low $NO_x$ firing methods is operated at very low excess air levels. This is possible because the unburned carbon in the flyash is measured and the pulverizers are adjusted to control the particles size of the pulverized coal and maintain a desired carbon level. The slagging and corrosion associated with deep staging is overcome by the concentric firing. Overall plant efficiency is obtained while still meeting performance objectives and emissions controls.

3 Claims, 5 Drawing Sheets

LOW EMISSION AND LOW EXCESS AIR STEAM GENERATING SYSTEM AND METHOD

This is a continuation-in-part of Application Ser. No. 08/174,777, filed on Dec. 12, 1993 now abandoned.

BACKGROUND OF THE INVENTION

The present invention relates to a coal fired steam generating system and method which produces low emissions of nitrogen oxides, employs low excess air and maximizes overall efficiency.

Nitrogen monoxide (NO) and nitrogen dioxide ($NO_2$) are byproducts of the combustion process of virtually all fossil fuels. Historically, the quantity of these inorganic compounds in the products of combustion was not sufficient to affect boiler performance and their presence was largely ignored. In recent years, oxides of nitrogen have been shown to be key constituents in the complex photochemical oxidant reaction with sunlight to form smog. Today, the emission of $NO_2$ and NO (collectively referred to as $NO_x$) is regulated by both state and federal authorities and has become an important consideration in the design of fuel firing equipment.

The formation of $NO_x$ in the combustion process is often explained in terms of the source of nitrogen required for the reaction. The $NO_x$ can originate from the oxidation of nitrogen in atmospheric air in which the product is referred to as "thermal $NO_x$" or from the organically bound nitrogen components found in all solid and liquid fossil fuels which are termed "fuel $NO_x$". The formation of thermal $NO_x$ can be decreased by reducing the residence time, the combustion temperature, and the concentration of $O_2$. On the other hand, the fuel $NO_x$ is less temperature dependant, but is a strong function of the fuel-air stoichiometry and residence time. A number of techniques to control fuel $NO_x$ have been developed that involve modification of the combustion process such as low excess air firing and air staging. Under fuel-rich conditions and with sufficient residence time available, the conversion of fuel nitrogen to harmless molecular nitrogen, rather than to $NO_x$ can be maximized.

One technique for reducing the formation of $NO_x$ is the use of air staging or overfire air by which the combustion process is spread out. The overfire air nozzles are located in the windbox above the uppermost coal nozzles. Approximately 20% of the total combustion air to a burning zone is introduced through these overfire air nozzles. As a result, the fireball is at slightly sub-stoichiometric air conditions. When combined with low excess air firing in the range of perhaps 15 to 20% excess air, the $NO_x$ formation is controlled by driving the major fraction of the fuel nitrogen compounds into the gas phase under overall fuel-rich conditions. In this atmosphere of oxygen deficiency, there occurs a maximum rate of decay of the evolved intermediate nitrogen compounds to $N_2$. Following the introduction of the remaining overfire air, the slow burning rate reduces the peak flame temperature to curtail the thermal $NO_x$ production in the later stages of combustion. The use of even lower levels of excess air (below 15%) would further reduce the formation of $NO_x$ and increase plant efficiency but that normally results in the incomplete combustion of the fuel and high levels of unburned carbon in the flyash thereby reducing efficiency.

Another one of the developments that has been used to reduce the formation of $NO_x$ is the offset air or concentric firing technique disclosed in U.S. Pat. No. 4,294, 178. In this firing technique, tangential firing is employed with the fuel and primary combustion air being introduced tangentially to an imaginary circle in the center of the furnace and with the secondary combustion air being directed tangentially to a larger concentric circle. This patent also discloses the use of flue gas recirculation which is also tangentially introduced between the fuel and secondary air streams. This concentric or offset air firing technique is another way of spreading out the combustion process and has the effect of reducing the formation of $NO_x$. Simultaneously, it also reduces the slagging and corrosion of the furnace walls. With deep staged firing where conditions at the burner level would normally be a reducing atmosphere, severe slagging and corrosion of the water walls would occur. Therefore, with this deep staging, it is necessary to use concentric firing where the secondary combustion air is on the outside of the fireball against the walls, so that an oxidizing atmosphere is maintained at the wall. This reduces slagging, corrosion and the need for soot blowing.

SUMMARY OF THE INVENTION

A steam generator employing low $NO_x$ firing methods for coal including staged combustion with overfire air and concentric firing of fuel and secondary air is operated at further reduced excess air levels while controlling the carbon loss in the flyash. More specifically, the excess air levels are reduced to reduce $NO_x$ emissions and increase efficiency while controlling the particle size of the coal to both minimize carbon loss and maximize efficiency all in conjunction with the adjustment between the secondary and overfire air to minimize $NO_x$ formation.

DESCRIPTION OF THE PREFERRED EMBODIMENTS

Figure 1:
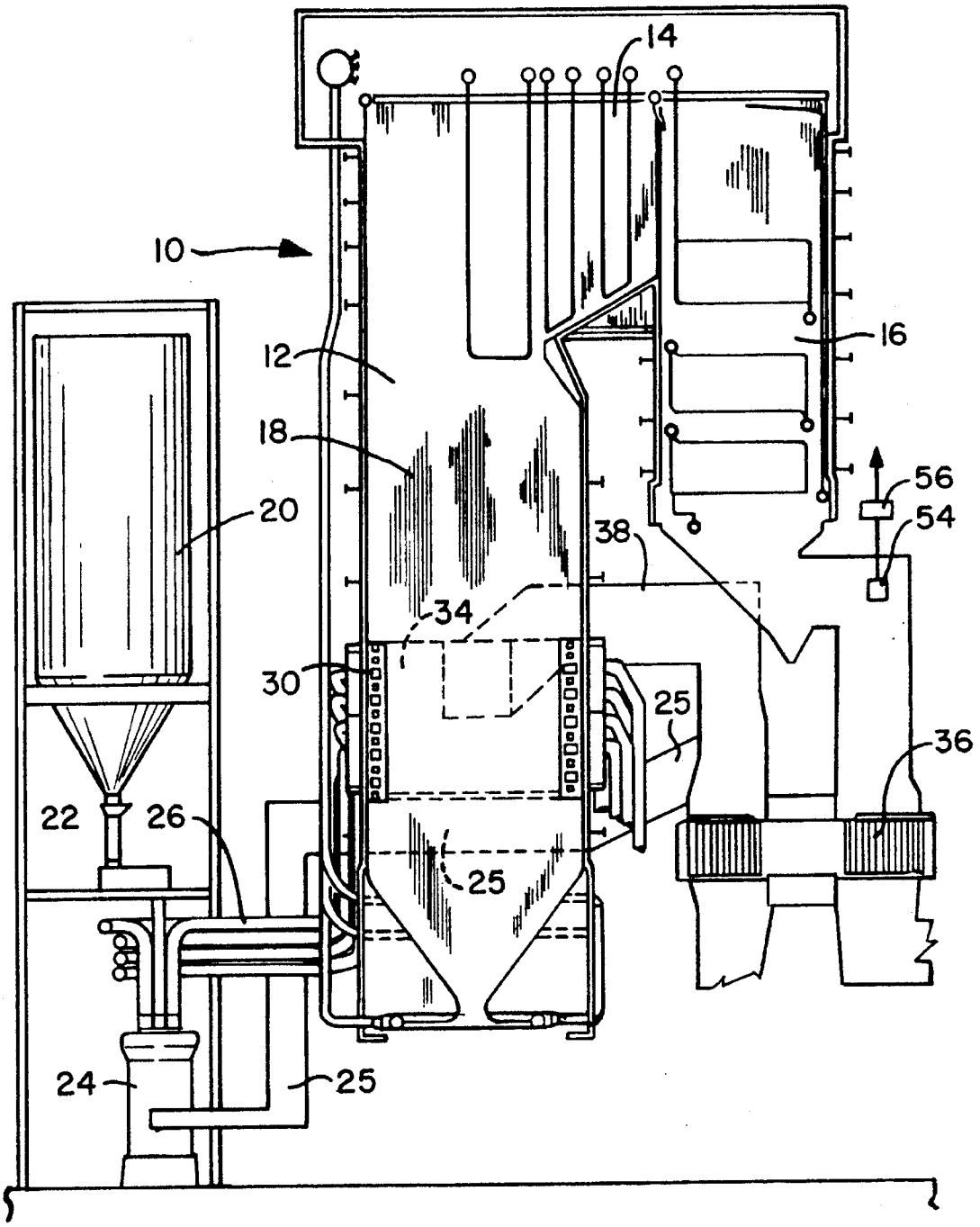
FIG. 1 is a diagrammatic representation of a coal fired steam generator in the nature of a vertical sectional view.

FIG. 1 of the drawings illustrates a typical steam generating unit 10 having a furnace section 12, a horizontal gas pass 14 and a back pass 16. The furnace section is lined with water wall tubes 18 in which the steam is generated. The horizontal gas pass and the back pass contain various combinations of economizers, superheaters and reheaters which are all conventional for such steam generators and have not been specifically identified in the drawings.

The steam generator illustrated is of the known tangentially fired type. The coal silo 20 feeds coal to the feeder 22 which controls the rate of flow to pulverizer 24. These pulverizers not only have means for pulverizing but also include adjustable classifiers which control the particle size of the coal discharged from the pulverizer. The hot primary combustion air is also fed to the pulverizer by duct 25 and it carries the pulverized coal through and out of the pulverizer to the burners. With proper adjustment of the classifier, the particles of the proper size are discharged with the primary combustion air and the oversize particles are recycled to the pulverizing rollers. Pulverizers of this type are conventional and the details have not been illustrated.

Figure 2:
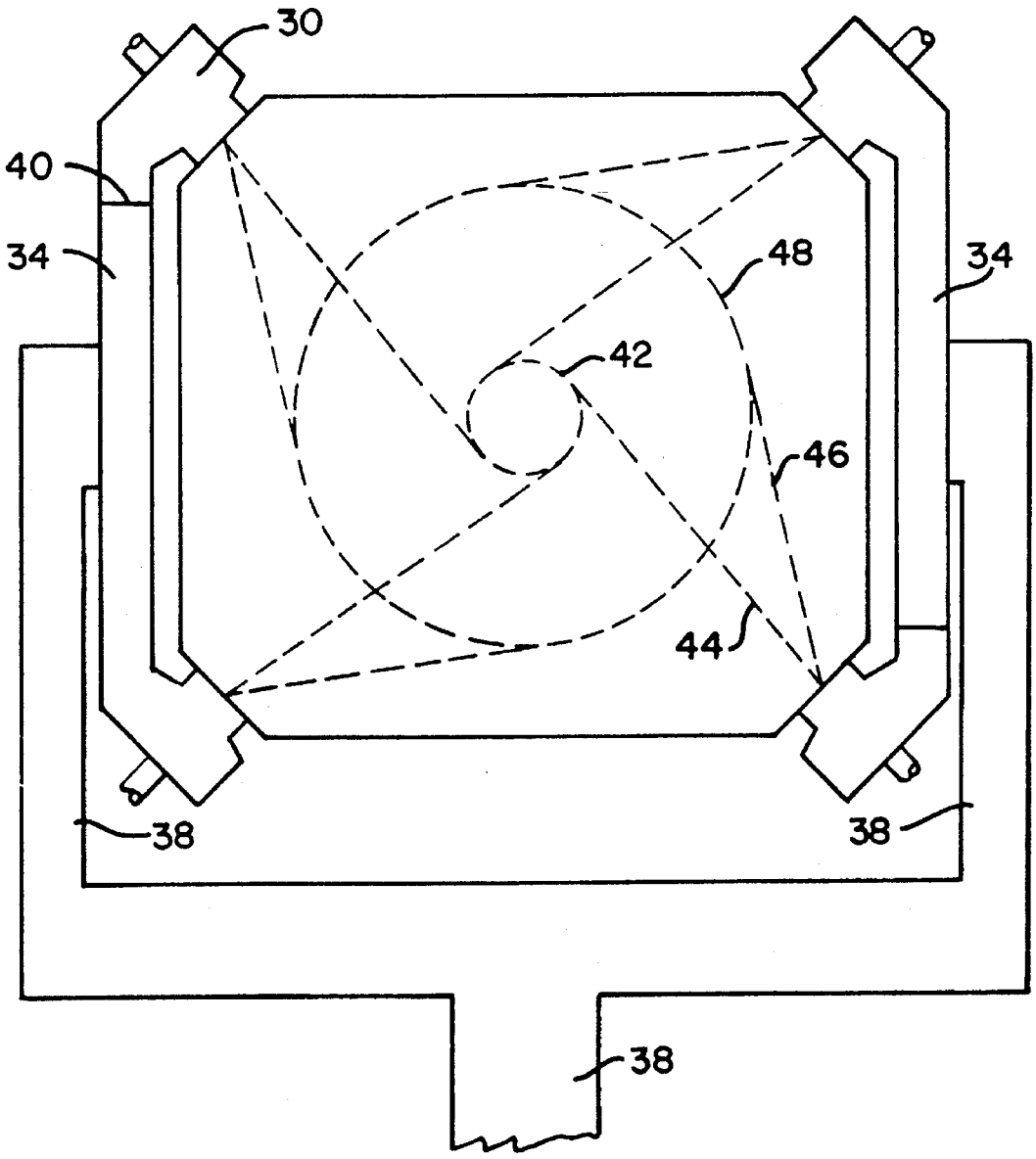
FIG. 2 is a sectional plan view of the furnace section of the steam generator.
Figure 3:
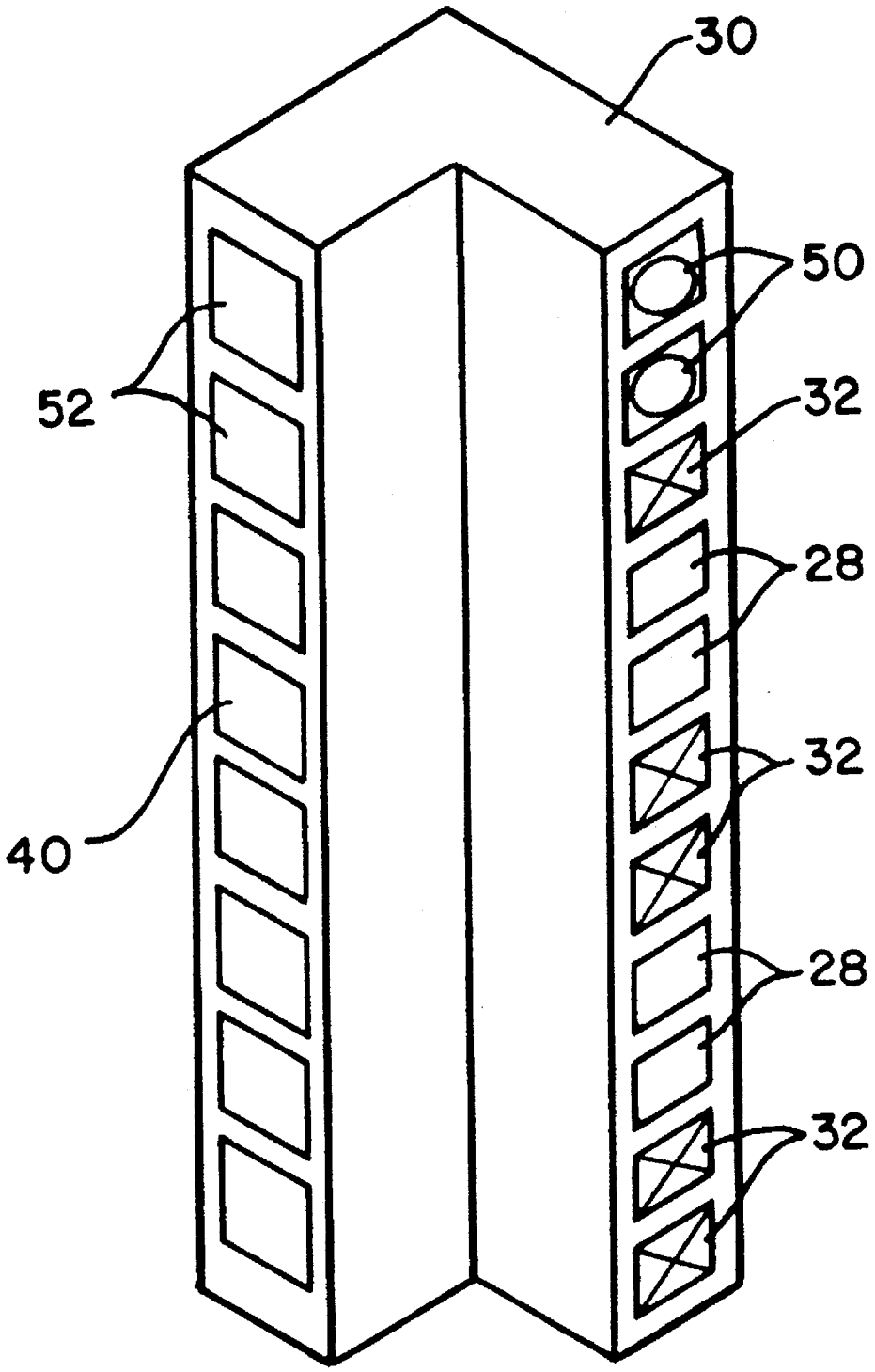
FIG. 3 is a isometric view of one of the tangential windboxes.

The pulverized and sized coal particles together with the primary combustion air are fed through the coal pipes 26 to the coal nozzles in the tangential windboxes 30. As shown in FIG. 3, each windbox has a plurality of coal nozzles 28 plus a plurality of secondary air nozzles 32. The windboxes are connected to each other by the air plenums 34 as seen in FIG. 2. The air preheater 36, which transfers the heat from the combustion gases to the incoming air, supplies the air for both the primary air to the pulverizers through duct 25 and the secondary air to the plenum 34 and windboxes 30 through the duct 38. Located between the plenum 34 and the windboxes 30 are dampers at 40 which control the quantity of air fed into the furnace from the windboxes at any particle level of the windboxes.

As seen in FIG. 2, concentric firing is employed in which the secondary air is directed away from the fuel towards the adjacent furnace wall in order to reduce the entrainment of secondary air by the expanding primary air/coal fire ball. The coal and primary air are directed at the tangent of the small circle 42 along lines 44 while the secondary air is directed along lines 46 tangent to the larger circle 48. Thus, air is effectively withheld from the fire ball and effects the early furnace stoichiometry reducing the formation of $NO_x$. Also, the air being directed along the walls of the furnace maintains an oxidizing atmosphere adjacent the walls and helps prevent slagging and corrosion. The ability to maintain an oxygen concentration at the wall while having a deficiency of oxygen in the fireball is critical to the success of low excess air operation. Also, reducing the slagging reduces the need for soot blowing and thereby increases efficiency.

FIG. 3 is a simplified illustration of a tangential firing windbox showing the dampers 40, the coal/primary air nozzles 28 and the secondary air nozzles 32. At the top of the windbox are the overfire air nozzles 50 which are controlled by the dampers 52 also at the top. Overfire air could also be introduced at higher levels above the main windbox 30. In the illustrated version of the tangential windbox, the fuel/primary air nozzles have been grouped or clustered together (rather than alternating with the secondary air) which is another way of controlling the rate of burning and thus the maximum temperatures and $NO_x$ production.

In accordance with the present invention, one object is to perform the combustion process with low excess air, below 15% and preferably between 5 and 10% as compared with a normal excess air rate of 20% or more. Low excess air reduces $NO_x$ formation and tends to increase overall plant efficiency by reducing stack and draft losses. As previously explained, a mere reduction in the excess air will result in unburned fuel which will appear as carbon in the flyash. In order to accomplish low excess air firing, the present invention controls the combustion process according to the quantity of carbon in the flyash. A number of commercial instruments are available for this purpose. One technique is to burn the flyash sample turning the carbon to carbon dioxide and then measuring the quantity of carbon dioxide given off by a known quantity of flyash. Carbon content can also be measured by resistivity and neutron activation techniques. The flyash sample is preferably taken in the flue gas stream leaving the back pass of the steam generator or leaving the air preheater. An alternative location would be in the flyash hopper of the precipitator.

Shown in FIG. 1 is a flyash carbon detector 54 located in the back pass of the steam generator 10 following the back pass heat exchange surfaces. The measurement signal from the detector 54 is fed to a control unit 56 which is adapted to control the classifier of the pulverizer 24 to control the particle size of the coal. It might be assumed that the pulverizer classifier could merely be operated at the finest setting so that it always provides very fine particles to keep the carbon down. However, it is undesirable to operate the pulverizer with the particle size setting less than needed for the circumstances. First of all, operating the pulverizers at a particle size less than necessary takes considerable energy and reduces overall plant efficiency. This energy requirement must be weighed against the benefits to be derived. Also, if the classifier is set too fine, there is increased recirculation of the larger particles from the classifier to the pulverizer rolls which in turn reduces the capacity of the pulverizer to process fresh coal. This results in inadequate pulverizer capacity for the steam generator or the requirement for excessive pulverizer capacity.

Figure 4:
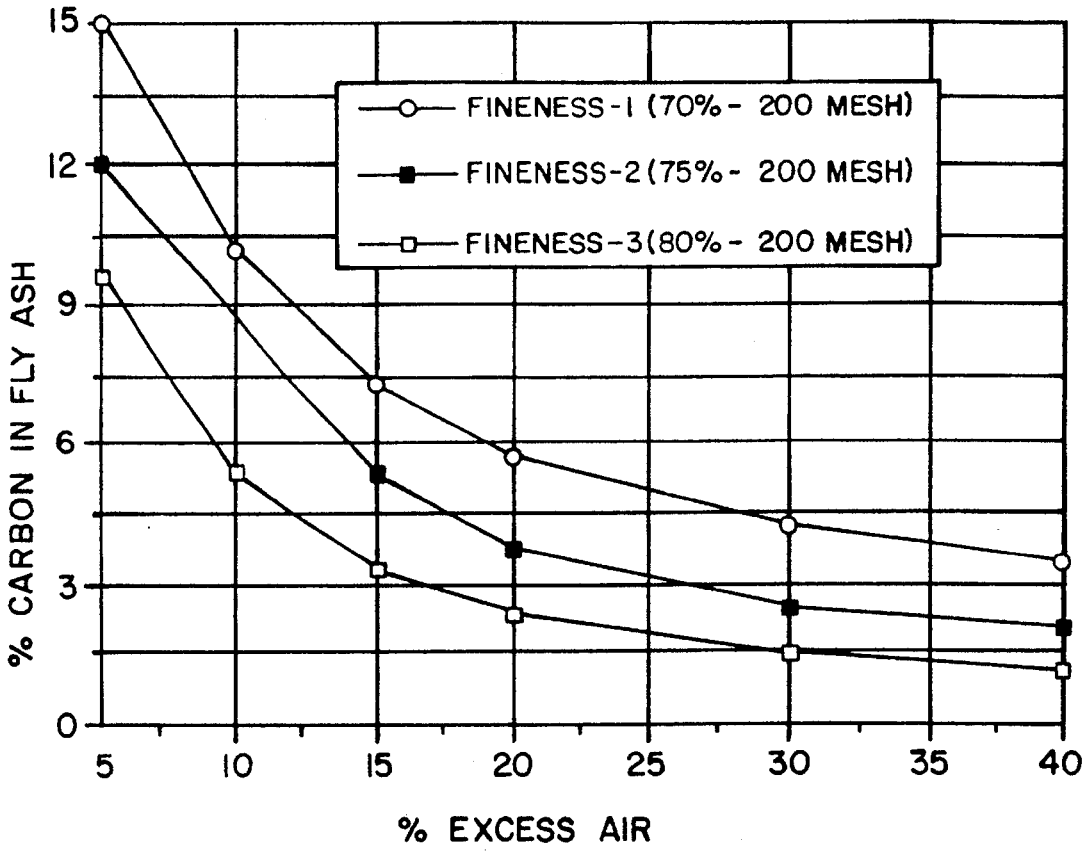
FIG. 4 is a graph of the percent carbon in the flyash versus the percent excess air as a function of the particle size of the coal.

The carbon detector 54 is connected through a plant operating controller to the pulverizer 24 so as to control the pulverizer classifier settings. The graph of FIG. 4 illustrates the relationship between excess air and the carbon in the flyash as a function of the particle size of the pulverized coal. It can readily be seen that the percent carbon in the flyash increases as the excess air is reduced and that it decreases as the particle size is reduced. It can also be seen that the percent carbon in the flyash can be maintained at a desired level even when the excess air is reduced if the particle size is also reduced. If the flyash is to be utilized in byproducts such as cinder block or aggregate, no more than 5% carbon in the flyash is allowed. If the flyash is merely sent for disposal, a tradeoff occurs between the energy lost in the carbon in the flyash and the energy required to pulverize the coal finer. In such instances, a plant efficiency analysis is made. These computerized systems take plant data and calculate the plant efficiency on-line. The maximum plant efficiency would then determine the optimum level of carbon in the flyash versus the power required to further pulverize the coal. One such system is the available Combustion Engineering Total On-Line Performance System (CETOPS).

Figure 5:
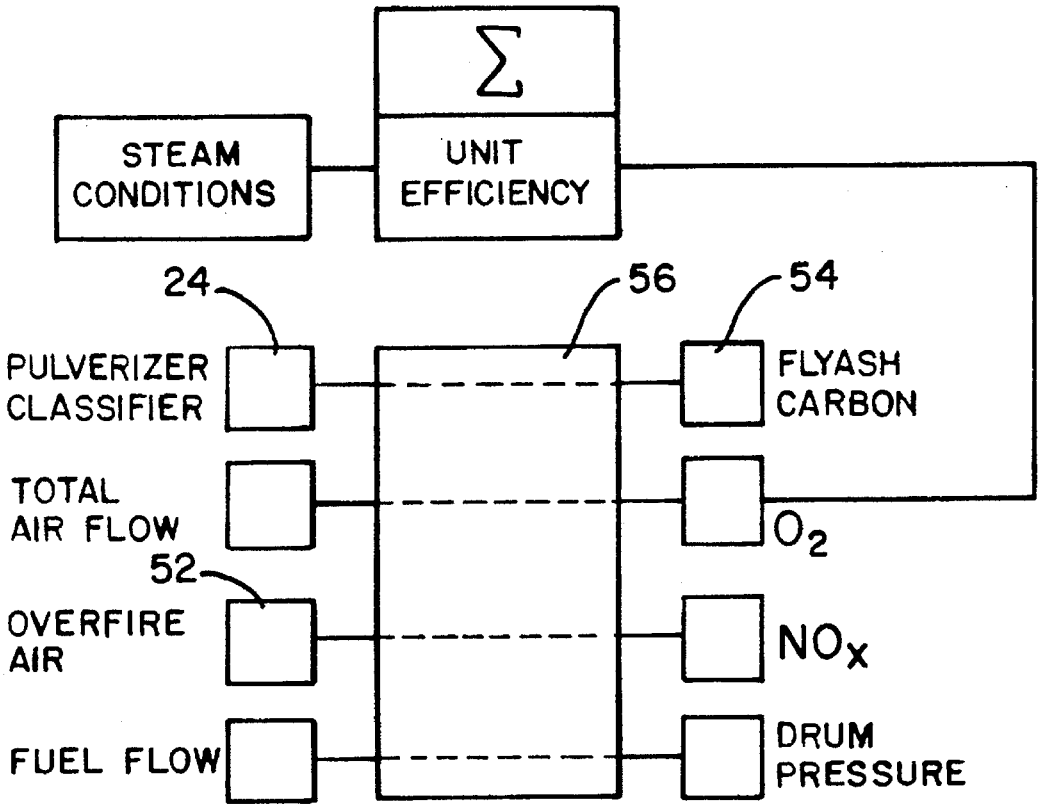
FIG. 5 is a representation of the various parameters measured and the functions controlled.

FIG. 5 is a schematic representation of the pertinent operating parameters that would be measured and the corresponding function to be controlled. In this system, certain standard control linkages are maintained. The fuel flow is still maintained by the steam drum pressure as a measure of load and the total air flow is maintained by oxygen measurement in the flue gas. However, in the present invention, the oxygen setpoint is reduced to achieve a low level of excess air below 15% and is continuously adjusted downward to lower $NO_x$ and increase efficiency to the point where the unburned carbon in the flyash can no longer be maintained under control by adjusting the pulverizer. Likewise, the ratio of overfire air to total air is increased to reduce $NO_x$ with the carbon in the flyash being the limiting parameter. With these adjustments, the maximum plant efficiency with the lowest $NO_x$ emissions has been achieved. The $NO_x$ production as measured in the flue gases is used to control the ratio of overfire air compared to secondary air.

The present invention ties in the concepts of overall excess air, staged combustion, the concentric firing system, particle size, carbon in the flyash, and $NO_x$ in a feedback control system. In addition, by tying in overall plant operations such as draft loss, soot blowing, and plant efficiency, optimized plant efficiency can be obtained while still meeting performance objectives which include steam flow, $NO_x$ emissions, and carbon in the flyash. The desire is to meet the required level of emissions at the steam flow needed at the highest possible efficiency. In order to do that, the total fuel flow and air flow must be considered as well as the plant operating parameters. Thus for a given $NO_x$ level required, the system will try to adjust the overfire air amount to meet the $NO_x$. This will cause the mill classifier to adjust to a certain coal fineness. This in turn will cause a certain level of deposition on the walls and tubes on the boiler requiring a certain level of soot blowing and a certain amount of draft loss. When evaluated together a certain plant efficiency is calculated. The system will now try to reduce the excess air in the system. The initial effect of reducing the amount of excess air will be to increase the plant efficiency by reducing the stack losses and reducing draft losses. There are additional power consumers that are also dependant upon gas flow, such as scrubber liquid flow rate, precipitator power, etc. that will also be reduced. Should a finer grind be required, the deposition rate will be decreased which may require less soot blowing and thus consume less auxiliary power. Therefore, these new conditions will achieve the desired steam flow, $NO_x$ emissions, and carbon in the flyash at a better efficiency than the first point. This process can be repeated until the point where the system parameters can no longer cope with the unburned either because it rises asymptotically as excess air approaches zero or because the mill classifier cannot achieve any further improvements in fineness. In this manner, the plant performance is optimized.

I claim:

1. A method of operating a pulverized coal fired steam generator comprising the steps of:

a) pulverizing coal to a selected particle size and firing said pulverized coal and primary air into a furnace of said steam generator in such a manner that streams of said pulverized coal and said primary air are directed tangentially to an inner imaginary, substantially horizontal circle in the center of said furnace;

b) introducing secondary combustion air into said furnace in such a manner that the streams of said secondary combustion air are directed tangentially to an outer imaginary circle concentric with and surrounding said inner circle to reduce $NO_x$ in the flue gases and maintain an oxidizing atmosphere adjacent the furnace walls;

c) introducing overfire combustion air into said furnace at a location above said pulverized coal, primary combustion air and secondary combustion air to further reduce $NO_x$ in the flue gases;

d) measuring the operating efficiency of said steam generator;

e) adjusting the amount of said primary, secondary and overfire combustion air to a level below 15% above stoichiometric to maximize the operating efficiency of said steam generator and adjusting the ratio of said secondary combustion air and said overfire combustion air so as to minimize the $NO_x$ in the flue gas;

f) measuring the percentage of unburned carbon in flyash;

g) establishing a desired maximum percentage of unburned carbon in the flyash by optimizing the energy required for finer grinding against the energy saved from reduced carbon loss; and h) adjusting the particle size of said pulverized coal to maintain said desired percentage of unburned carbon in the flyash.

2. A method as recited in claim 1, wherein said percentage carbon in said flyash is maintained at 5% or less.

3. A method as recited in claim 1, wherein said excess combustion air is maintained at a level between 5 and 10% above stoichiometric.

* * * * *

UNITED STATES PATENT AND TRADEMARK OFFICE

CERTIFICATE OF CORRECTION

PATENT NO. : 5,488,916

DATED : February 6, 1996

INVENTOR(S) : Carl R. Bozzuto

It is certified that error appears in the above-indentified patent and that said Letters Patent is hereby corrected as shown below:

Front page, item [63], "Dec. 12, 1993" should read --Dec. 29, 1993--.

Column 1, line 6, "Dec. 12, 1993" should read --Dec. 29, 1993--.

Column 6, line 2, delete "the".

Column 6, line 5, delete "the".

Column 6, line 6, delete "the".

Signed and Sealed this

Eighteenth Day of June, 1996

*Attest:*

Bruce Lehman

BRUCE LEHMAN

*Attesting Officer*

*Commissioner of Patents and Trademarks*